US006296456B1

(12) United States Patent
Thornelow et al.

(10) Patent No.: US 6,296,456 B1
(45) Date of Patent: Oct. 2, 2001

(54) POSITIVE DISPLACEMENT PUMP SYSTEMS WITH A VARIABLE CONTROL ORIFICE

(75) Inventors: Alec Thornelow; Derek Keith Brighton; Matthew Williamson, all of Kent (GB)

(73) Assignee: Dana Automotive Limited, Rochester (GB)

( * ) Notice: Subject to any disclaimer, the term of this patent is extended or adjusted under 35 U.S.C. 154(b) by 0 days.

(21) Appl. No.: 09/457,717

(22) Filed: Dec. 10, 1999

(30) Foreign Application Priority Data

Dec. 11, 1998 (GB) ..... 9827463
Oct. 27, 1999 (GB) ..... 9925301

(51) Int. Cl.[7] ..... F04B 49/00; F04B 23/00

(52) U.S. Cl. ..... 417/310; 417/299; 417/308; 417/441

(58) Field of Search ..... 417/299, 308, 417/310, 440, 441

(56) References Cited

U.S. PATENT DOCUMENTS

| | | | | |
|---|---|---|---|---|
| 3,756,749 | * | 9/1973 | Aldinger | 417/220 |
| 3,788,770 | | 1/1974 | Johnson et al. | 417/62 |
| 4,166,713 | * | 9/1979 | Debrey | 417/40 |
| 4,245,964 | | 1/1981 | Rannenberg | 417/287 |
| 4,445,818 | * | 5/1984 | Ohsaki et al. | 417/288 |
| 4,913,102 | * | 4/1990 | Ohmura et al. | 123/41.12 |
| 5,187,936 | * | 2/1993 | Kast et al. | 60/734 |
| 5,738,501 | * | 4/1998 | Eisenmann | 417/310 |

FOREIGN PATENT DOCUMENTS

| | | | | |
|---|---|---|---|---|
| 26 30 736 | | 3/1977 | (DE) | F04C/1/16 |
| 0 428 374 | | 5/1991 | (EP) . | |
| 0428374 | * | 7/1994 | (EP) . | |
| 0660000 | * | 9/1995 | (EP) . | |
| 2 090 915 | | 7/1982 | (GB) | F04C/11/00 |
| 2320955 | * | 7/1998 | (GB) . | |
| 93 09349 | | 5/1993 | (WO) | F04C/15/04 |

* cited by examiner

*Primary Examiner*—Charles G. Freay
*Assistant Examiner*—Timothy P. Solak
(74) *Attorney, Agent, or Firm*—Wenderoth, Lind & Ponack, L.L.P.

(57) ABSTRACT

A positive displacement pump system has first and second delivery passages for pumped fluid and a main delivery passage receiving flow from the first delivery passage and, via a non return valve, from the second delivery passage. A control valve is provided to apportion flow from the first and second delivery passage to an overspill port. A pressure sensitive control orifice is provided in the main discharge passage to receive the combined flows and the control orifice is of variable size.

14 Claims, 6 Drawing Sheets

POSITIVE DISPLACEMENT PUMP SYSTEMS WITH A VARIABLE CONTROL ORIFICE

BACKGROUND OF THE INVENTION

This invention relates to positive displacement pump systems and is more particularly concerned with such systems in which deliveries from two positive displacement pump sources are available to be fed to a common supply passage.

SUMMARY OF THE INVENTION

According to this invention there is provided a positive displacement pump system having first and second delivery passages for pumped fluid, a main discharge passage connected to receive a flow from the first delivery passage and to receive through a non-return valve a flow from the second delivery passage, a control orifice disposed in the main discharge passage at a location to receive the combined flows, and a control valve for apportioning the flow from the second delivery passage between the main discharge passage and overspill porting and controlling the by-passing of a proportion of the flow from the first delivery passage through the overspill porting. The control valve comprises a valve member slidably mounted in a bore in a valve body, and a first end of the bore is in communication with the main discharge passage at a location upstream of the control orifice. The control valve also comprises a spring which is disposed in a spring chamber in the valve body and which urges the valve member towards the first end of the bore. The spring chamber communicates with the main discharge passage at a location downstream of the control orifice. The valve member has a first metering land between the first end of the valve bore and the overspill porting, and a second metering land between the spring chamber and the overspill porting. The valve body has an annular by-pass port variably obstructed by the second land and connected to the second delivery passage at a location upstream of the non-return valve, and the by-pass port and the axial end portion of the second land nearer the overspill porting are so shaped in relation to each other that on movement of the valve member against the spring loading, the communication between the by-pass port and the space in the valve bore at the axial side of the second land nearer to the first end of the valve bore is initially at least, less than filly annular as the valve member moves against the spring loading. In addition, the control orifice has a variable size.

According to a preferred feature of the invention, the overspill porting comprises an annular overspill port extending about the valve bore. The edge ofthe overspill port nearer the first land and the end of the first land nearer the first end of the valve bore are so shaped in relation to each other that on movement of the valve member against the spring loading, the communication between the by-pass port and the first end of the valve bore is, initially at least, less than fully annular as the valve member moves against the spring loading.

The progressive increase in the area of communication towards fully annular communication in these constructions may be achieved by providing peripheral notches in the end face ofthe first and/or the second land or otherwise making the periphery of such end face non-circular. Alternatively, notches may be cut in an axial end edge of the port.

In some arrangements, the control orifice comprises a fixed orifice and an additional pressure sensitive orifice. The fixed orifice may be located in an axial through bore provided in the valve member. In other arrangements the control orifice comprises a pressure sensitive orifice having a number of orifice sizes dependent on pressure.

BRIEF DESCRIPTION OF THE DRAWINGS

The invention will now be described in more detail with reference by way of example to the accompanying diagrammatic drawings in which.

DETAILED DESCRIPTION OF THE INVENTION

Figure 1:
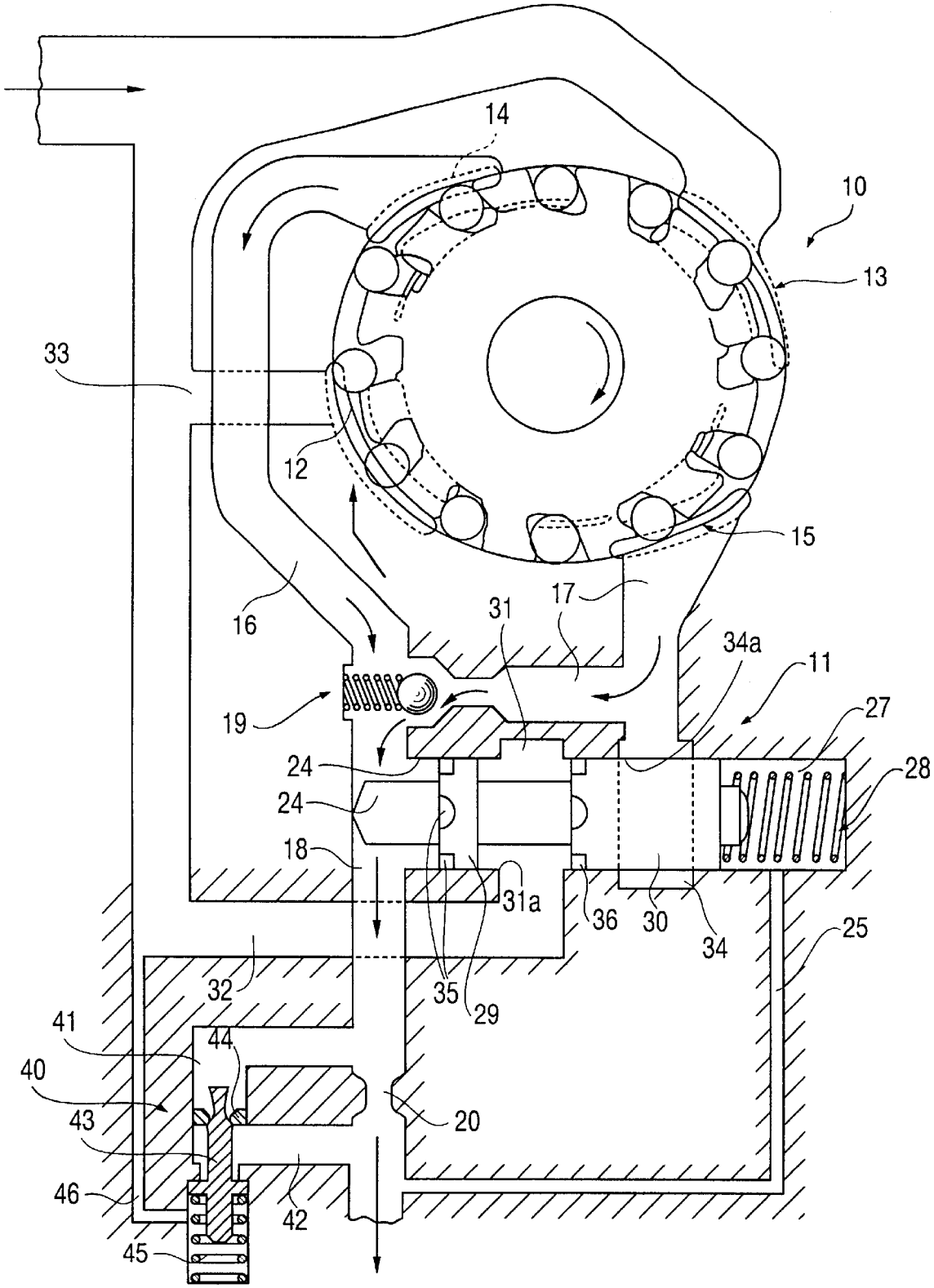
FIG. 1 shows a positive displacement pump system according to the invention in a low pressure low-speed condition.

Referring first FIG. 1, the system comprises a positive displacement pump 10 (in this instance, it is the well-known roller type) and has two inlet ports 12, 13 and two outlet ports 14, 15 from which the pumped fluid flows into first and second delivery passages 16, 17, respectively. The downstream end of delivery passage 16 is in direct communication with the upstream end of a main discharge passage 18. The downstream end of the second delivery passage 17 communicates with the discharge passage 18 through a non-return valve 19. A discharge orifice 20 is provided in the discharge passage 18.

The control valve 11 comprises a spool valve member 22 slidably mounted in a bore 24 in a body part. The first end of the bore 24 opens to the main discharge passage 18 upstream of the orifice 20. The second end of the bore forms a chamber 27 housing a spring 28 which urges the valve member into abutment with a wall of the main discharge passage 18. The chamber 27 communicates through a duct 25 with the passage 18 at a location downstream of the orifice 20 so that the pressure drop across the orifice opposes the force of the spring 28.

The valve member has first and second lands 29, 30 for which, in the position shown in FIG. 1, the former is disposed between the main discharge passage and an annular overspill port 31 in the bore 24. Port 31 communicates through a passage 32 with a passage 33 leading to the inlet port 12. Land 30 is axially spaced from land 29 and, in the position shown in FIG. 1, obstructs an annular by-pass port 34 which is in communication with the second delivery passage 17 at a location upstream of the non-return valve 19. The lands 29, 30 have in the periphery of their end portions closest to the main discharge passage a number of notches 35, 36 respectively opening to the end face.

A pressure sensitive (variable control) orifice 40 is also provided in a passage 41 which communicates with the discharge passage 18 upstream of the orifice 20. Downstream of the orifice 40 is a further passage 42 which communicates with the discharge passage downstream of the orifice 20. The pressure sensitive orifice 40 comprises a piston 43 urged into its seat 44 by a spring 45. The spring 45 is disposed in a chamber which communicates via a passage 46 with the low pressure spill return passage 32.

Figure 2:
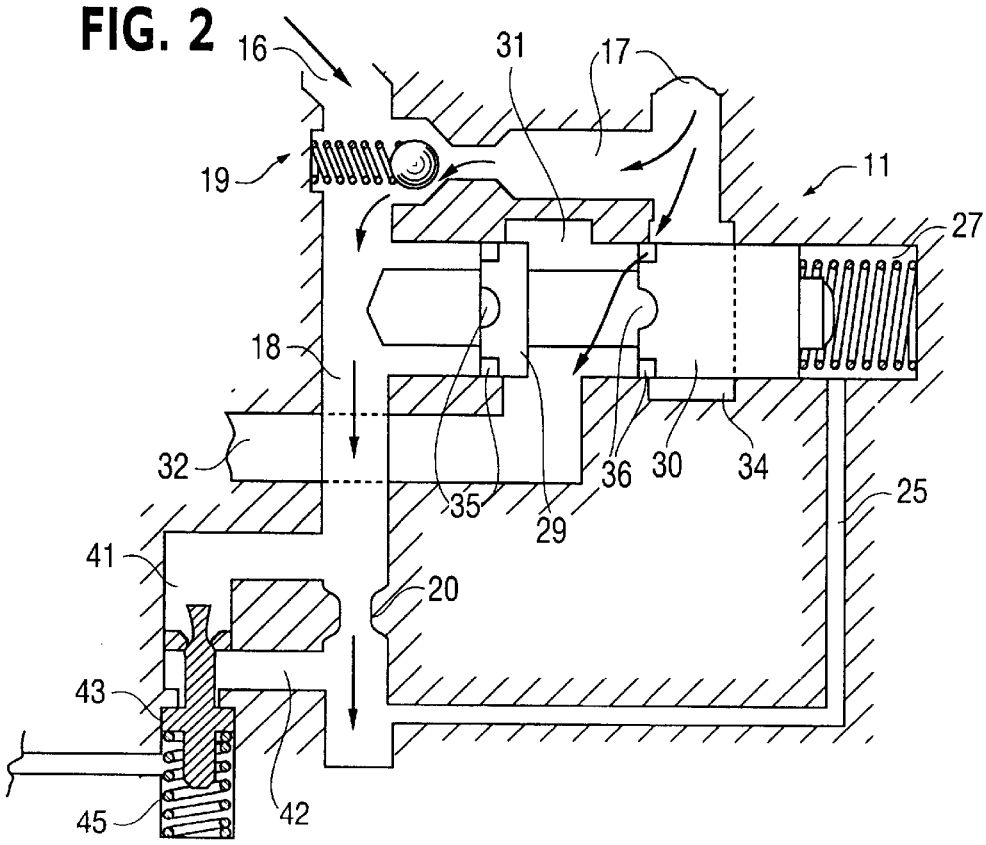
FIGS. 2 and 3, respectively, show the control valve of the system of FIG. 1 in low pressure medium speed and low pressure high speed conditions.

FIG. 1 shows the valve in its position during low pressure low-speed operation of the pump. The pressure in the main discharge passage is low, and the lands 29 and 30 prevent communication between the discharge passage 18 and the overspill port 31 and the by-pass port 34, respectively, so that the whole flow from the second outlet port 15 flows through the non-return valve 19 and joins the flow from the first outlet port 14 in the main discharge passage leading to the point of utilisation. As the pump speed increases, assuming for the moment that the pressure at the downstream side of orifice 20 remains constant, the increase in pressure at the upstream side of the orifice urges the spool valve member 22 to move against the spring 28 force as shown in FIG. 2. As the notches 36 in the end portion of the second land pass the circular edge 34*a* of the by-pass port 34, a flow of fluid through the by-pass port to the overspill port 31 occurs which is less than if there were fully annular communication between the port and the bore. Therefore, the flow to the overspill port 31 is not greatly affected by i.e., is less sensitive to, small movements of the valve member on initial opening. An increasing proportion of the flow from the second delivery port 15 is by-passed through the overspill port 34 as the pump speed increases. As the valve member moves rightward, the area of communication increases to the extend that the plane of the end face passes the edge 34*a* of the port 34 and communication is then fully annular.

Figure 3:
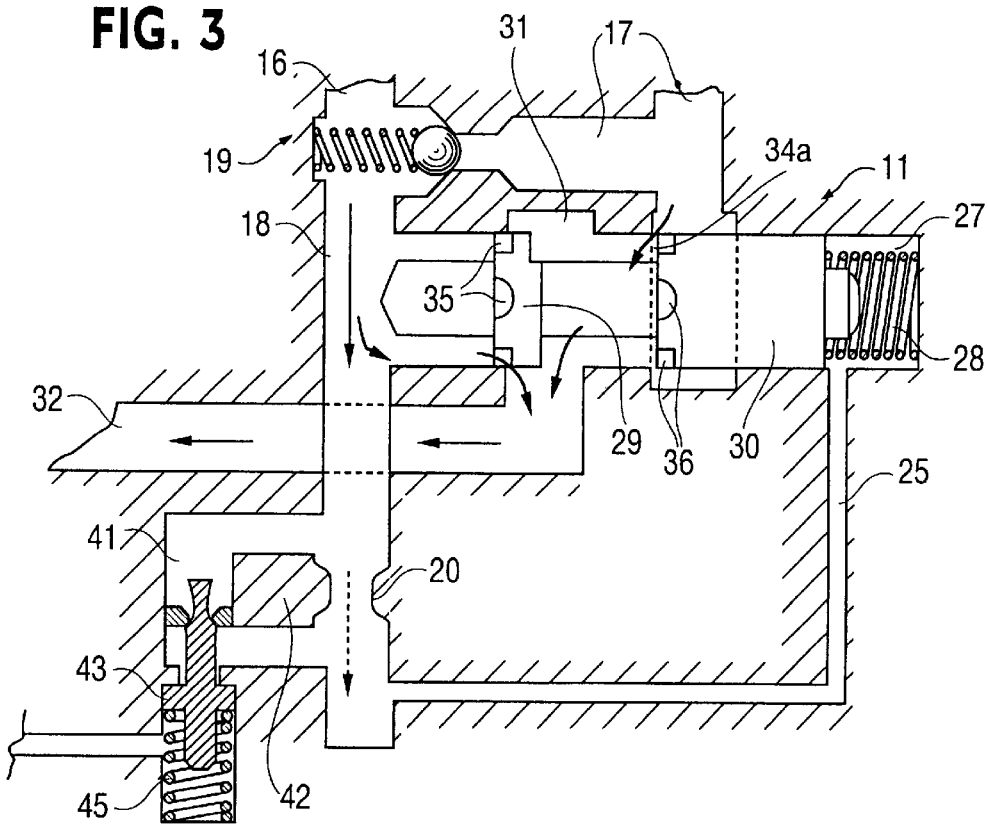

Up to this point the non-return valve 19 has remained open. However, at their maximum opening, the notches 36 are capable of passing to the overspill port 31 the entire flow from the second delivery passage 17 when the end face of land 30 moves past the edge 34*a*. The resulting fall in pressure in the second delivery passage 17 tends to produce a reverse flow through the non-return valve 19, which causes the non-return valve 19 to close. The next increase in the pump speed causes a sudden and substantial rightward movement of the spool valve member 22, which moves notches 35 to a point relative to the edge 31a of overspill port 31 at which the fresh excess of fluid can pass to the overspill port through the notches 35, see FIG. 3. This rightward movement of the valve member causes a sharp fall in the pressure in the second delivery passage 17 and a consequent reduction in the power requirement of the pump. Further increases in pump speed move the valve member further rightward permitting increased flow of fluid from the first delivery passage 16 to pass through notches 35 to the overspill port 34. Thus, with progressively increasing pump speed, all of the fluid delivered to the second delivery passage 17 is passed at low pressure through the overspill port, and an increasing proportion of the fluid delivered to the first delivery passage is also passed through the overspill port.

When operating at low pressure, the pressure sensitive valve 40 remains closed as the pressure in the discharge passage 18 is not sufficient to move the piston 43. When the pump is operating at high pressure, the pressure in the discharge passage is sufficient to move the piston 43 against the force of the spring 45 so as to open the orifice 40 thus causing a greater flow to the point of utilisation downstream of the orifices 20, 40. This greater flow can be a gradual increase or a sudden increase depending on the geometry of the piston.

Figure 4:
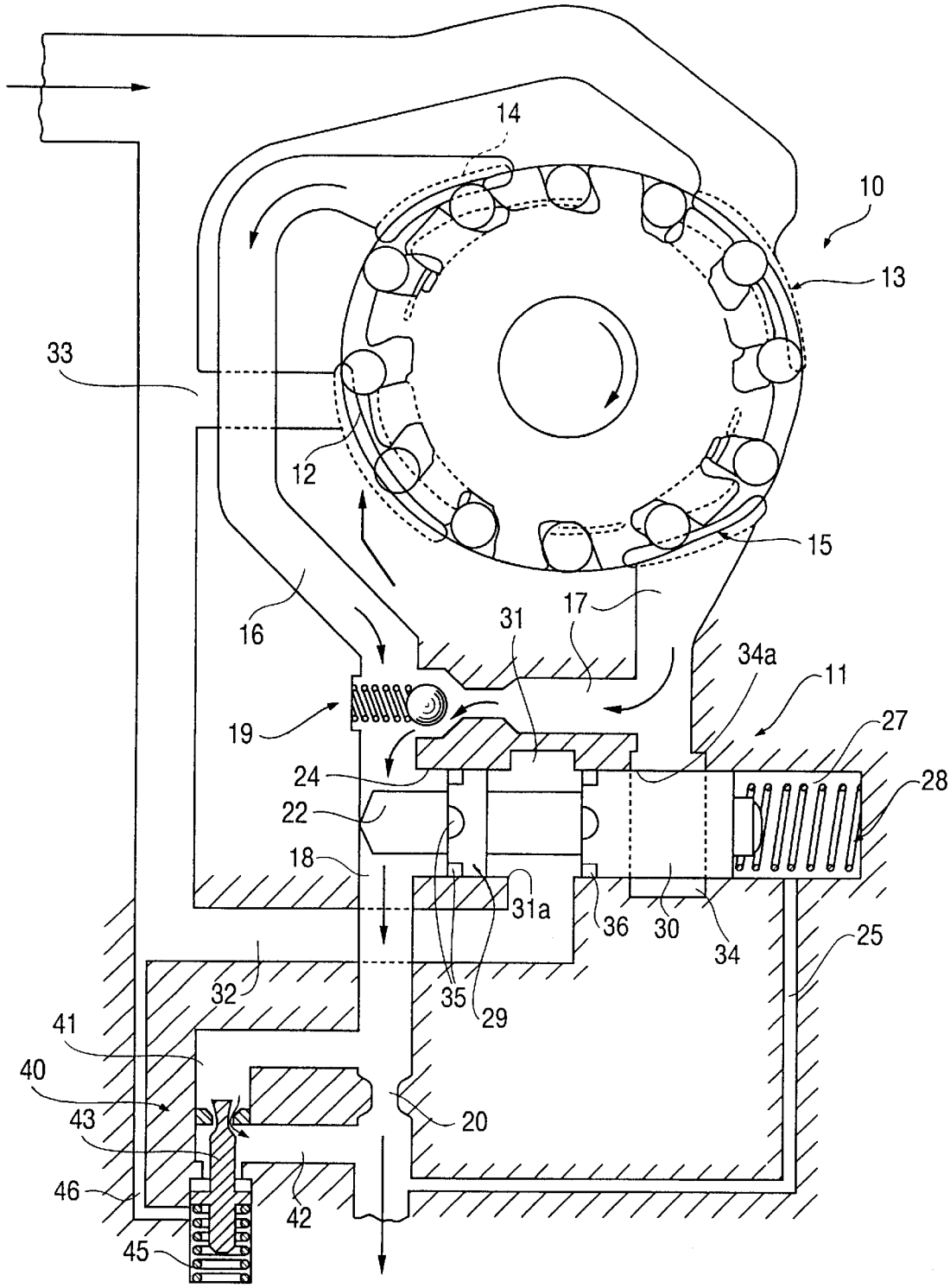
FIGS. 4, 5 and 6 are similar to FIGS. 1, 2 and 3 but show the system in high pressure operation.
Figure 5:
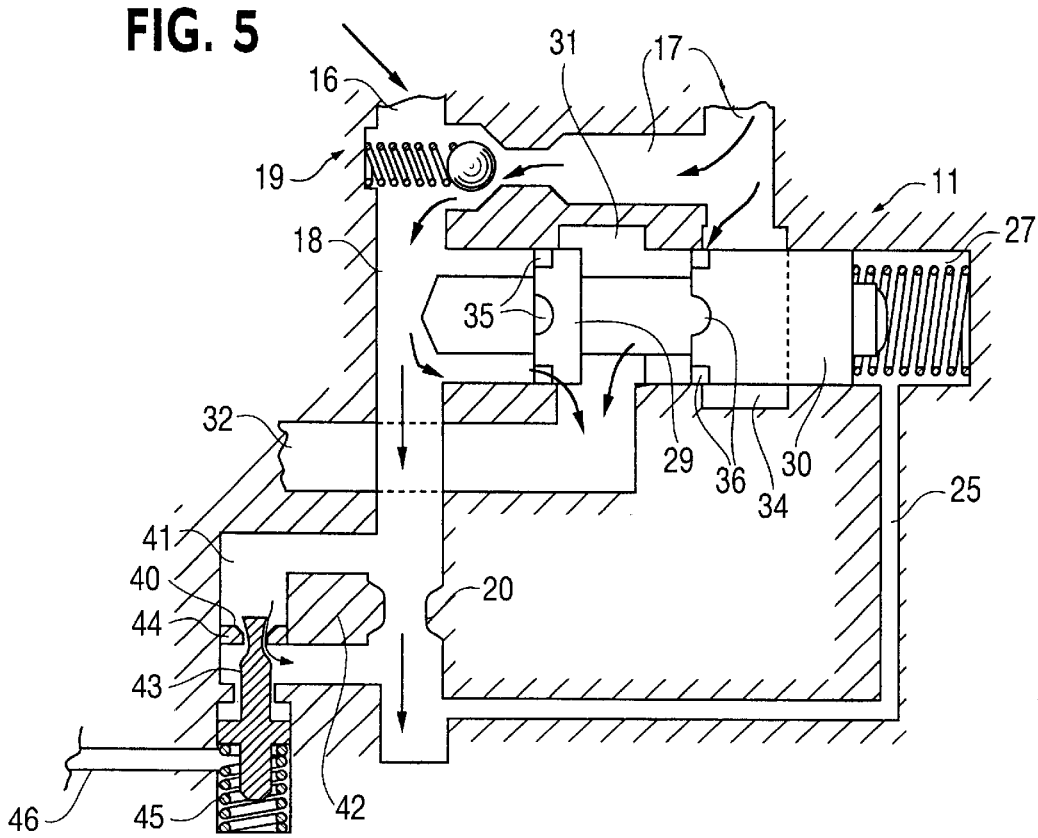
Figure 6:
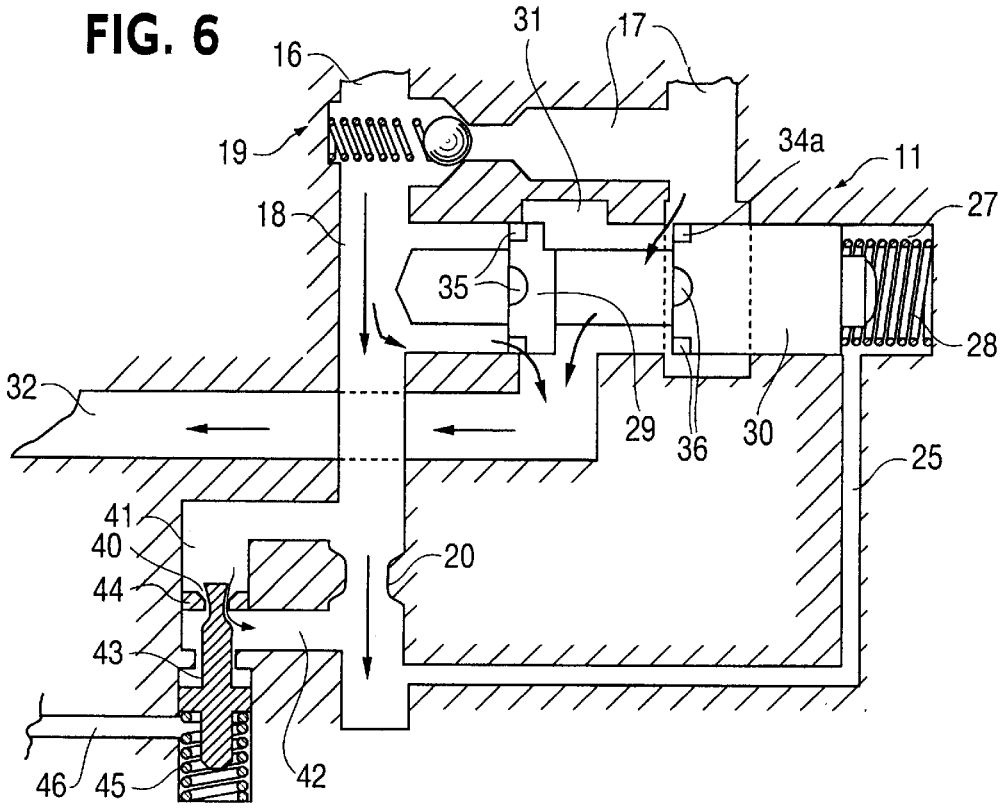

Once the second pressure sensitive orifice 40 is opened, there is a greater demand for fluid from the pump and so the control valve 11 closes as shown in FIG. 4 such that all flow from the second outlet 15 flows via the second delivery passage 17 into the discharge passage 18.

As pump speed increases the valve 11 opens in the same manner as described above in the low pressure operation. Fluid from the second outlet 15 starts to flow into the overspill port 31 until at a certain speed the non-return valve 19 closes and all flow from the second outlet goes into the overspill port. At even higher speeds some of the flow from the first outlet port 14 goes into the overspill port 31.

In the arrangement shown, there is an additional pressure sensitive variable control orifice device 40 included in the hydraulic circuit. This allows the primary orifice size to be set small so that the pressure drop which causes the energy saving valve to operate, can occur at lower speed when the system pressure is low, thereby providing energy savings sooner. It also provides increased flows either suddenly or gradually when they are required at high pressures, in which case energy savings occurs at higher speed. Also, if the pressure sensitive orifice device takes the form of a profiled needle moving in an orifice, the size of the orifice can be varied to compensate for changes in the flow rate due to pressure variations at any point on the output flow curve.

In alternative arrangements, the variable orifice could be replaced by any pressure sensitive orifice device such as a piston, poppet or ball acting against the spring.

In the diagrams, the pump is shown, for clarity, using both a fixed orifice and a pressure sensitive orifice device, but in practice the same results could be obtained by using a suitably designed single pressure sensitive orifice. An optional arrangement could use a variable orifice controlled by a solenoid or other means.

Figure 7:
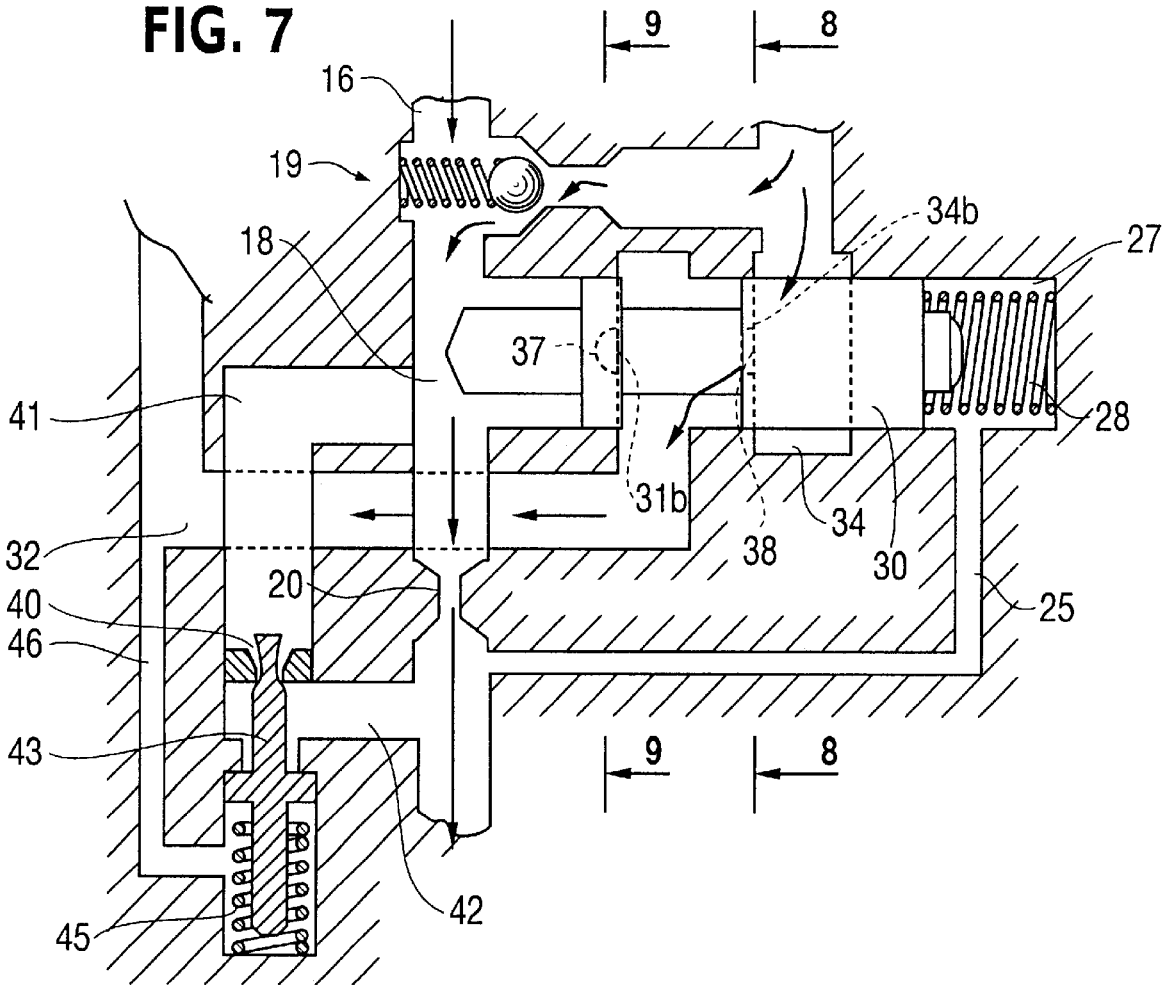
FIG. 7 illustrates a modified arrangement of the control valve.
Figure 8:
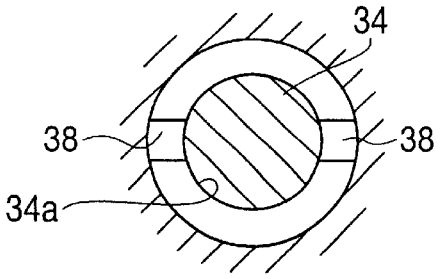
FIGS. 8 and 9 are respectively fragmentary sectional end views on the lines 8—8 and 9—9 of FIG. 7, respectively.
Figure 9:
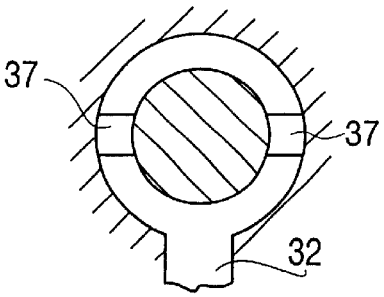

In an alternative arrangement illustrated in FIGS. 7 to 9, the two lands 29, 30 of the valve member have fully planar end faces, and notches 37, 38 are instead formed in the axial end faces 31*b*, 34*b* of the ports 31, 34 which co-operate with the lands in controlling the opening ofthe ports. The notches 37, 38 operate in conjunction with the ends of the lands 29, 30 in exactly the same way as the notches 35, 36 operate in conjunction with the edges 31*a* of the ports in the arrangement of FIG. 1.

Figure 10:
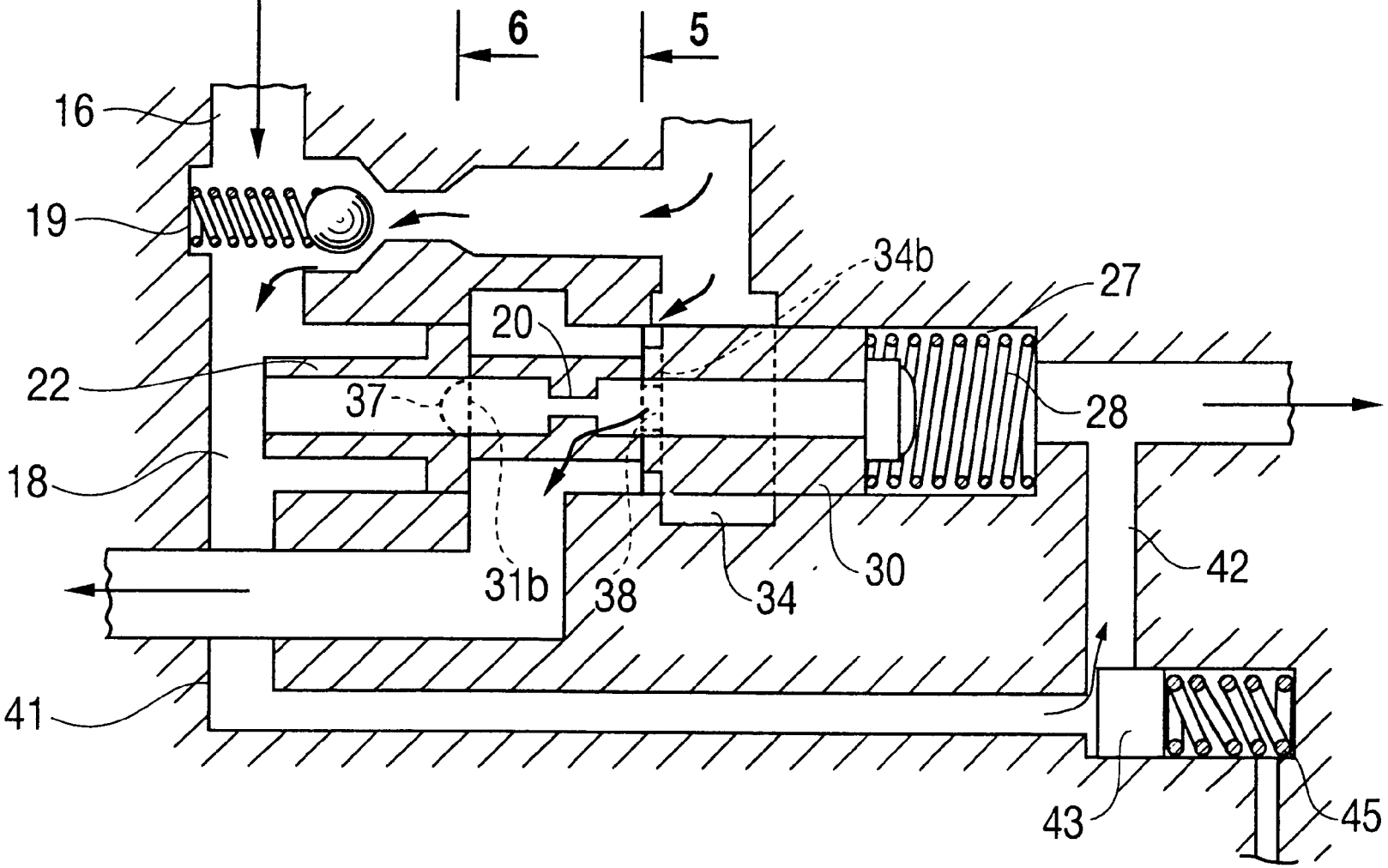
FIG. 10 shows an alternative control valve according to the invention.

In a further alternative control valve arrangement shown in FIG. 10, the spool valve member 22 has an axial through bore which in turn incorporates the orifice 20. The pressure sensitive orifice 40 in this embodiment comprises a spring loaded block valve 50 which is still effectively located parallel to the control orifice 20. The operation of the control valve is equivalent to the FIG. 1 arrangement except that the use of a through bore renders the FIG. 10 valve more compact.

What is claimed is:

1. A positive displacement pump system comprising:

a first delivery passage for transferring a first flow portion of pumped fluid;

a second delivery passage for transferring a second flow portion of pumped fluid;

a main discharge passage communicating with said first delivery passage and said second delivery passage so as to receive the first flow portion and the second flow portion therefrom as a main flow;

a non-return valve located between said second delivery passage and said main discharge passage;

a pressure-sensitive variable control orifice in said main discharge passage for receiving the main flow, said pressure-sensitive variable control orifice being adapted to automatically open an amount based on a pressure of the main flow;

an overspill passage; and a control valve for apportioning the second flow portion from said second delivery passage between said main discharge passage and said overspill passage, and for controlling a by-passing of the main flow from said main discharge passage to said overspill passage, said control valve comprising:

a valve body including a bore therethrough, an overspill port communicating with said bore and said overspill passage, an annular by-pass port communicating with said bore and said second delivery passage upstream of said non-return valve, and a spring chamber, said bore having a first end in communication with said main discharge passage upstream of said pressure-sensitive variable control orifice, said spring chamber communicating with said main discharge passage downstream of said pressure-sensitive variable control orifice;

a valve member slidably mounted within said bore and having a first metering land between said first end of said bore and said overspill port, and having a second metering land between said spring chamber and said overspill port, said valve member being slidably mounted within said bore such that said second metering land variably obstructs said annular by-pass port;

a spring arranged in said spring chamber so as to urge said valve member towards said first end of said bore, wherein said annular by-pass port and an axial end of said second metering land nearest to said overspill port are arranged such that when said valve member slides within said bore against said spring, a communication between said annular by-pass port and a space in said bore at an axial side of said second metering land nearest to said first end of said bore is initially less than fully annular.

2. The system of claim 1, wherein said overspill port comprises an annular overspill port extending around said bore, an edge of said overspill port nearest to said first metering land and an axial end of said first metering land nearest to said first end of said bore are arranged such that when said valve member slides within said bore against said spring, a communication between said annular by-pass port and said first end of said bore is initially less than fully annular.

3. The system of claim 2, wherein peripheral notches are formed in at least one of said axial end of said second metering land nearest to said overspill port and said axial end of said first metering land nearest to said first end of said bore.

4. The system of claim 3, further comprising a fixed orifice in parallel with said pressure-sensitive variable control orifice with respect to the main flow.

5. The system of claim 4, wherein said valve member includes an axial through-bore, said fixed orifice being located within said axial through-bore of said valve member.

6. The system of claim 2, wherein peripheral notches are formed in an axial edge of at least one of said overspill port and said annular by-pass port.

7. The system of claim 6, further comprising a fixed orifice in parallel with said pressure-sensitive variable control orifice with respect to the main flow.

8. The system of claim 7, wherein said valve member includes an axial through-bore, said fixed orifice being located within said axial through-bore of said valve member.

9. The system of claim 2, further comprising a fixed orifice in parallel with said pressure-sensitive variable control orifice with respect to the main flow.

10. The system of claim 9, wherein said valve member includes an axial through-bore, said fixed orifice being located within said axial through-bore of said valve member.

11. The system of claim 1, further comprising a fixed orifice in parallel with said pressure-sensitive variable control orifice with respect to the main flow.

12. The system of claim 11, wherein said valve member includes an axial through-bore, said fixed orifice being located within said axial through-bore of said valve member.

13. The system of claim 1, wherein said pressure-sensitive variable control orifice comprises a piston and a spring for urging said piston in a direction so as to close said pressure-sensitive variable control orifice.

14. The system of claim 1, wherein said pressure-sensitive variable control orifice is adapted to automatically open an amount based only on a pressure ofthe main flow upstream of said pressure-sensitive variable control orifice.

* * * * *